US005512238A

United States Patent [19]

Kosa et al.

[11] Patent Number: 5,512,238

[45] Date of Patent: Apr. 30, 1996

[54] FREE-MACHINING AUSTENITIC STAINLESS STEEL

[75] Inventors: Theodore Kosa; John H. Magee, Jr., both of Reading, Pa.

[73] Assignee: CRS Holdings, Inc., Wilmington, Del.

[21] Appl. No.: 473,412

[22] Filed: Jun. 7, 1995

[51] Int. Cl.[6] ..... C22C 38/42

[52] U.S. Cl. ..... 420/49

[58] Field of Search ..... 420/49; 148/32

[56] References Cited

U.S. PATENT DOCUMENTS

| | | |
|---|---|---|
| 2,687,955 | 8/1954 | Bloom . |
| 3,563,729 | 2/1971 | Kovach et al. . |
| 3,764,302 | 10/1973 | Troselius et al. . |
| 4,444,588 | 4/1984 | Ney, Sr. . |
| 4,797,252 | 1/1989 | Eckenrod et al. . |
| 4,933,142 | 6/1990 | Haswell, Jr. et al. . |
| 5,362,439 | 11/1994 | Bletton et al. . |

OTHER PUBLICATIONS

Y. Ono and H. Kaito, "Manufacturing Process and Properties of Stainless Steels", Kawasaki Steel Tech. Rpt., No. 14, Mar. 1986.

*Primary Examiner*—Deborah Yee

*Attorney, Agent, or Firm*—Dann, Dorfman, Herrell and Skillman

[57] ABSTRACT

An austenitic, stainless steel alloy consists essentially of, in weight percent, about:

| | |
|---|---|
| C | 0.030 max |
| Mn | 2.0 max |
| Si | 1.0 max |
| P | 0.05 max |
| S | 0.02–0.05 |
| Cr | 16.0–20.0 |
| Ni | 9.8–14.0 |
| Mo | 3.0 max |
| Cu | 0.8–1.5 |
| N | 0.035 max |

up to about 0.75 weight percent of an element selected from the group consisting of Ti and Cb, and the balance is essentially iron, wherein Cb is not more than about 0.1 weight percent when Ti≧(5×% C.) and Ti is not more than about 0.1 weight percent when Cb≧ (10×% C.). The alloy provides a unique combination of machinability, corrosion resistance, formability, and mechanical properties.

23 Claims, No Drawings

FREE-MACHINING AUSTENITIC STAINLESS STEEL

FIELD OF THE INVENTION

The present invention relates to an austenitic stainless steel alloy and in particular to an austenitic stainless steel alloy, and an article made therefrom, having a unique combination of good machining characteristics, corrosion resistance, formability, and transverse mechanical properties.

BACKGROUND OF THE INVENTION

In general, stainless steels are more difficult to machine than carbon and low-alloy steels because stainless steels have high strength and work-hardening rates compared to the carbon and low alloy steels. Consequently, it is necessary to use higher powered machines and lower machining speeds for machining the known stainless steels than for machining carbon and low-alloy steels. In addition, the useful life of a machining tool is often shortened when working with the known stainless steels.

AISI Types 304L, 316L, 321 and 347 stainless steels are austenitic, chromium-nickel and chromium-nickel-molybdenum stainless steels having the following compositions in weight percent:

| | Type 304 L wt. % | Type 316 L wt. % | Type 321 wt. % | Type 347 wt. % |
|---|---|---|---|---|
| C | 0.03 max | 0.03 max | 0.08 max | 0.08 max |
| Mn | 2.00 max | 2.00 max | 2.00 max | 2.00 max |
| Si | 1.00 max | 1.00 max | 1.00 max | 1.00 max |
| P | 0.045 max | 0.045 max | 0.045 max | 0.045 max |
| S | 0.03 max | 0.03 max | 0.03 max | 0.03 max |
| Cr | 18.0–20.0 | 16.0–18.0 | 17.0–19.0 | 17.0–19.0 |
| Ni | 8.0–12.0 | 10.–14.0 | 9.0–12.0 | 9.0–13.0 |
| N | 0.10 max | 0.10 max | 0.10 max | — |
| Mo | — | 2.0–3.0 | — | — |
| Ti | — | — | 5 × (% C + % N) to 0.70 | — |
| Nb + Ta | — | — | — | 10 × % C to 1.10 |
| Fe | Bal. | Bal. | Bal. | Bal. |

Source: METALS HANDBOOK® Desk Edition; Chapt. 15, pages 2–3; (1985). The AMS standards for these alloys restrict copper to not more than 0.75%.

The above-listed chromium-nickel and chromium-nickel-molybdenum stainless steels are known to be useful for applications which require good non-magnetic behavior, in combination with good corrosion resistance. In order to overcome the difficulties in machining the known stainless steels, some grades of stainless steels have been modified by the addition of elements such as sulphur, manganese, or phosphorus and/or by maintaining carbon and nitrogen at very low levels. However, there continues to be a demand for improved machinability in chromium-nickel and chromium-nickel-molybdenum stainless steels, particularly for production-type machining operations such as on an automatic screw machine.

Given the foregoing, it would be highly desirable to have an austenitic stainless steel that provides better machinability than is provided by the known austenitic stainless steels.

SUMMARY OF THE INVENTION

The problems associated with the known austenitic stainless steel alloys are solved to a large degree by an alloy in accordance with the present invention. The alloy according to the present invention is an austenitic stainless steel alloy that provides significantly improved machinability compared to the known chromium-nickel and chromium-nickel-molybdenum stainless steel alloys, without adversely affecting other desirable properties such as corrosion resistance, formability, and transverse mechanical properties.

The broad and preferred compositional ranges of the austenitic stainless steel of the present invention are as follows, in weight percent:

| | Broad | Pref. 1 | Pref. 2 | Pref. 3 | Pref. 4 |
|---|---|---|---|---|---|
| C | 0.030 max | 0.030 max | 0.030 max | 0.030 max | 0.030 max |
| Mn | 2.0 max | 2.0 max | 2.0 max | 2.0 max | 2.0 max |
| Si | 1.0 max | 1.0 max | 1.0 max | 1.0 max | 1.0 max |
| P | 0.05 max | 0.05 max | 0.05 max | 0.05 max | 0.05 max |
| S | 0.02–0.05 | 0.020–0.030 | 0.020–0.030 | 0.020–0.030 | 0.020–0.030 |
| Cr | 16.0–20.0 | 18.0–19.0 | 16.0–17.5 | 17.0–18.0 | 17.0–18.0 |
| Ni | 9.8–14.0 | 10.0–11.0 | 10.5–12.5 | 10.0–11.0 | 10.0–11.0 |
| Mo | 3.0 max | 1.0 max | 2.0–3.0 | 1.0 max | 1.0 max |
| Cu | 0.8–1.5 | 0.8–1.0 | 0.8–1.0 | 0.8–1.0 | 0.8–1.0 |
| N | 0.035 max | 0.030 max | 0.030 max | 0.030 max | 0.030 max |
| Ti | 0.75 max | 0.1 max | 0.1 max | (5 × % C) to 0.5 | 0.1 max |
| Cb | 0.75 max | 0.1 max | 0.1 max | 0.1 max | (10 × % C) to 0.5 |

The balance in each case is essentially iron except for the usual impurities found in commercial grades of such steels and minor amounts of additional elements which may vary from a few thousandths of a percent up to larger amounts that do not objectionably detract from the desired combination of properties provided by this alloy. In the Broad composition, Cb is not more than about 0.1% when Ti≧(5×% C.) and Ti is not more than about 0.1% when Cb≧(10×% C.).

The foregoing tabulation is provided as a convenient summary and is not intended thereby to restrict the lower and upper values of the ranges of the individual elements of the alloy of this invention for use in combination with each other, or to restrict the ranges of the elements for use solely in combination with each other. Thus, one or more of the element ranges of the broad composition can be used with one or more of the other ranges for the remaining elements in the preferred compositions. In addition, a minimum or maximum for an element of one preferred embodiment can be used with the maximum or minimum for that element from another preferred embodiment. Throughout this application, unless otherwise indicated, percent (%) means percent by weight.

DETAILED DESCRIPTION

In the alloy according to the present invention, carbon and nitrogen are restricted in order to benefit the machinability of the alloy. Carbon is restricted to not more than about 0.030%, better yet to not more than about 0.025%, and preferably to not more than about 0.020%. In addition, nitrogen is restricted to not more than about 0.035%, better yet to not more than about 0.030%, and preferably to not more than about 0.025%. For best results, the alloy contains not more than about 0.020% nitrogen.

Nickel is present in the alloy to provide the necessary austenitic structure. To that end, at least about 9.8%, better yet at least about 10.0%, and preferably about 10.5% nickel is present in the alloy to prevent ferrite or martensite formation and to insure good machinability. However, nickel is restricted to not more than about 14.0% and better yet to not more than about 12.5% because the benefits realized from nickel are not commensurate with the additional cost of a large amount of nickel in this alloy.

The amount of nickel present in this alloy is selected, at least in part, based on the desired amounts of molybdenum and chromium in the alloy. Thus, when the molybdenum content is below about 1.0% and the chromium content is above about 17.0%, the alloy preferably contains about 10.0% to about 11.0% nickel. Further, when the molybdenum content is about 2.0%–3.0% and the chromium content is about 16.0%–18.0%, the alloy preferably contains about 10.5% to about 12.5% nickel.

At least about 0.8% copper is present in this alloy to aid in stabilizing the austenitic structure of the alloy and to benefit the machinability of the alloy. Although copper is typically a residual element in an austenitic stainless steel such as Type 304 or Type 316, we have found that a significant improvement in machinability is obtained by including copper in the present alloy, within a controlled range.

Copper is restricted to not more than about 1.5%, better yet to not more than about 1.2% and, preferably to not more than about 1.0%. Too much copper adversely affects the corrosion resistance of this alloy. Moreover, the benefits realized from copper are not commensurate with the additional cost of including a large amount of copper in this alloy.

Chromium and molybdenum are present in the alloy to benefit corrosion resistance. More particularly, at least about 16%, better yet at least about 17%, and preferably at least about 18% chromium is present in this alloy to benefit general corrosion resistance. Up to about 3.0%, preferably about 2.0–3.0% molybdenum is present in the alloy to benefit pitting resistance. When optimum pitting resistance is not required, molybdenum is restricted to not more than about 1.0% in this alloy. Furthermore, an excessive amount of chromium can result in the undesirable formation of ferrite, so that chromium is restricted to no more than about 20.0%, better yet to no more than about 19%, and preferably to not more than about 18%, in this alloy.

The amount of chromium in this alloy is selected, at least in part, based on the desired amount of molybdenum in the alloy. Thus, for example, when the alloy is to contain about 2.0% or more molybdenum, chromium is restricted to about 16.0–18.0%. When molybdenum is restricted to not more than about 1.0%, the alloy can contain about 17.0–20.0% chromium.

At least about 0.02% sulphur is present in the alloy because it contributes to the machinability provided by this alloy. However, too much sulphur adversely affects the corrosion resistance, formability, and transverse mechanical properties of the alloy. Therefore, sulphur is restricted to not more than about 0.05% and preferably to not more than about 0.03%.

Up to about 0.75% titanium or columbium can be present in this alloy to stabilize carbon and nitrogen by forming titanium or columbium carbonitrides. Such carbonitrides benefit the alloy's resistance to intergranular corrosion when the alloy is exposed to elevated temperatures, e.g., following heating to about 1000° F. (530° C.). In order to realize the benefit provided by adding titanium to the alloy, the alloy contains an amount of titanium equal to at least about five times the desired amount of carbon (5×% C.). Similarly, in order to realize the benefit provided by adding columbium to the alloy, the alloy contains an amount of columbium equal to at least about ten times the desired amount of carbon (10×% C.). When titanium or columbium is added to the alloy in such quantities, the alloy preferably contains about 17.0–18.0% chromium and about 10.0–11.0% nickel.

Excessive amounts of titanium or columbium contribute to the formation of ferrite in this alloy, and adversely affect its hot workability, corrosion resistance, and non-magnetic behavior. Therefore, the amount of titanium or columbium added to the alloy is restricted to not more than about 0.75% and preferably to not more than about 0.5%. However, when titanium is a residual element, titanium is restricted to not more than about 0.1% and preferably to not more than about 0.01%. Similarly, when columbium is a residual element, columbium is restricted to not more than about 0.1%.

Up to about 2.0% manganese can be present in the alloy to promote the formation of manganese-rich sulfides which benefit machinability. In addition, free manganese aids in stabilizing the austenitic structure of the alloy. Preferably, at least about 1.0% manganese is present in the alloy.

Up to about 1.0% and better yet up to about 0.6% silicon can be present in the alloy from deoxidizing additions during melting. However, too much silicon promotes ferrite formation, particularly with the very low carbon and nitrogen present in this alloy. The formation of ferrite adversely affects the alloy's hot workability, corrosion resistance, and non-magnetic behavior.

Up to about 0.05% and better yet up to about 0.03% phosphorus can be present in the alloy to improve the quality of the surface finish of parts machined from this alloy. However, larger amounts of phosphorus tend to cause embrittlement and adversely affect the hot workability of the alloy and its machinability.

Up to about 0.01% calcium can be present in the alloy to promote formation of calcium-aluminum-silicates which benefit the alloy's machinability at high speeds with carbide cutting tools.

A small but effective amount of boron, up to about 0.005%, can be present in the alloy for its beneficial effect on hot workability.

No special techniques are required in melting, casting, or working the alloy of the present invention. Arc melting followed by argon-oxygen decarburization is the preferred method of melting and refining, but other practices can be used. In addition, this alloy can be made using powder metallurgy techniques, if desired. This alloy is also suitable for continuous casting techniques.

The alloy of the present invention can be formed into a variety of shapes for a wide variety of uses and lends itself to the formation of billets, bars, rod, wire, strip, plate, or sheet using conventional practices.

The alloy of the present invention is useful in a wide range of applications. The superior machinability of the alloy lends itself to applications requiring the machining of parts, especially using automated machining equipment.

EXAMPLES

In order to demonstrate the machinability provided by the present alloy, Examples 1–5 of the alloy of the present invention having the compositions in weight percent shown in Table 1 were prepared. For comparison purposes, comparative Heats A and B with compositions outside the range of the present invention were also prepared. Their weight percent compositions are also included in Table 1.

TABLE 1

| Ex./Ht. No. | C | Mn | Si | P | S | Cr | Ni | Mo | Cu | Co | N |
|---|---|---|---|---|---|---|---|---|---|---|---|
| 1 | 0.016 | 1.17 | 0.43 | 0.024 | 0.029 | 18.27 | 10.04 | 0.48 | 0.76 | 0.20 | 0.035 |
| 2 | 0.013 | 1.17 | 0.43 | 0.021 | 0.030 | 18.26 | 10.02 | 0.48 | 1.00 | 0.20 | 0.033 |
| 3 | 0.018 | 1.21 | 0.57 | 0.021 | 0.024 | 16.53 | 11.08 | 2.06 | 0.77 | 0.21 | 0.015 |
| 4 | 0.020 | 1.21 | 0.58 | 0.021 | 0.022 | 16.62 | 11.05 | 2.03 | 1.00 | 0.21 | 0.015 |
| 5 | 0.018 | 1.21 | 0.57 | 0.021 | 0.021 | 16.59 | 11.07 | 2.02 | 1.00 | 0.21 | 0.014 |
| A | 0.016 | 1.16 | 0.43 | 0.023 | 0.030 | 18.23 | 10.01 | 0.48 | 0.42 | 0.20 | 0.037 |
| B | 0.022 | 1.19 | 0.58 | 0.019 | 0.023 | 16.53 | 11.06 | 2.03 | 0.48 | 0.21 | 0.016 |

Alloy A is representative of a commercially available form of AISI Type 304/304L stainless steel. Alloy B is representative of a commercially available form of AISI Type 316/316L stainless steel.

The Examples 1–5 and the comparative Heats A and B were prepared from 400 lb. heats which were melted under argon cover and cast as 7.5 in. (19.05 cm) square ingots. The ingots were maintained at a temperature of 2250° F. (1232° C.) for 2 hours and then pressed to 4 in. (10.16 cm) square billets. The billets were ground to remove surface defects and the ends were cut off. The billets were hot rolled to form intermediate bars with a diameter of 2.125 in. (5.40 cm). For Examples 1 and 2 and comparative Heat A, the intermediate bars were hot rolled to a diameter of 0.7187 in. (1.82 cm) from a temperature of 2200° F. (1204° C.). For Examples 3–5 and comparative Heat B, the intermediate bars were hot rolled to a diameter of 0.7187 in. (1.82 cm) from a temperature of 2250° F. (1232° C.). The round bars were straightened and then turned to a diameter of 0.668 in. (1.70 cm). All of the bars were pointed, solution annealed at 1950° F. (1065° C.), water quenched, and acid cleaned to remove surface scale. The annealed bars were cold drawn to a diameter of 0.637 in. (1.62 cm), the pointed ends were cut off, and the bars were restraightened, and then rough ground to a diameter of 0.627 in. (1.592 cm). The bars were then ground to a final diameter of 0.625 in. (1.587 cm).

To evaluate machinability, the bars of Examples 1–5 and comparative Heats A and B were tested on an automatic screw machine. A rough form tool was used to machine the 0.625 in. (1.59 cm) diameter bars at a speed of 129 sfpm to provide parts having a contoured surface defined by a small diameter of 0.392 in. (1.00 cm) and a large diameter of 0.545 in. (1.38 cm). All the tests were performed with a rough form tool feed of 0.002 ipr using a 5% solution of Qwerl™ 540 cutting fluid (manufactured by Quaker Chemical Corporation). The large diameter was then finish machined to a diameter of 0.530 in. (1.35 cm) using a finish form tool. As a consequence of gradual wear induced on the rough form tool by the machining process, the small diameter of the machined parts gradually increases. Testing of each composition was terminated when a 0.003 in. (0.076 mm) increase in the small diameter of the machined parts was observed. Improved machinability is demonstrated when a significantly higher number of parts is machined compared to a reference material.

The results of the machinability tests are shown in Table 2 as the number of parts machined (No. of Parts). For Examples 1–3 and comparative Heats A and B, each alloy was tested in three separate runs. However, since the compositions of Examples 4 and 5 are similar, the bars of Examples 4 and 5 were tested together in five separate runs. The average number of parts machined (Avg.) for each alloy and the weight percents of copper, chromium, and molybdenum for each alloy tested are also included in Table 2 for convenient reference.

TABLE 2

| Ex./ Ht. No. | Cu | Cr | Mo | No. of Parts | | | | | Avg. |
|---|---|---|---|---|---|---|---|---|---|
| 1 | 0.76 | 18.27 | 0.48 | 260 | 240 | 240 | | | 247 |
| 2 | 1.00 | 18.26 | 0.48 | 410 | 400 | 330 | | | 380 |
| 3 | 0.77 | 16.53 | 2.06 | 430 | 320 | 450 | | | 400 |
| 4 | 1.00 | 16.62 | 2.03 | 240 | 550 | 340 | 400 | 350 | 376 |
| 5 | 1.00 | 16.59 | 2.02 | | | | | | |
| A | 0.42 | 18.23 | 0.48 | 270 | 120 | 180 | | | 190 |
| B | 0.48 | 16.53 | 2.03 | 210 | 200 | 170 | | | 193 |

The data in Table 2 clearly show the superior machinability of Examples 1–5 compared to Heats A and B.

The terms and expressions that have been employed herein are used as terms of description and not of limitation. There is no intention in the use of such terms and expressions to exclude any equivalents of the features described or any portions thereof. It is recognized, however, that various modifications are possible within the scope of the invention claimed.

What is claimed is:

1. An austenitic, stainless steel alloy consisting essentially of, in weight percent, about:

| | |
|---|---|
| C | 0.030 max |
| Mn | 2.0 max |
| Si | 1.0 max |
| P | 0.05 max |
| S | 0.02–0.05 |
| Cr | 16.0–20.0 |
| Ni | 9.8–14.0 |
| Mo | 3.0 max |
| Cu | 0.76–1.5 |
| N | 0.035 max |

up to about 0.75 weight percent of an element selected from the group consisting of Ti and Cb, and the balance being essentially iron, wherein Cb is not more than about 0.1 weight percent when Ti≧(5×% C.) and Ti is not more than about 0.1 weight percent when Cb≧(10×% C.).

2. The alloy according to claim 1 which contains no more than about 0.025 weight percent carbon.

3. The alloy according to claim 1 which contains no more than about 0.020 weight percent carbon.

4. The alloy according to claim 1 which contains no more than about 0.030 weight percent nitrogen.

5. The alloy according to claim 1 which contains no more than about 0.025 weight percent nitrogen.

6. The alloy according to claim 1 which contains no more than about 12.5 weight percent nickel.

7. The alloy according to claim 1 which contains at least about 10.0 weight percent nickel.

8. The alloy according to claim 1 which contains at least about 10.5 weight percent nickel.

9. The alloy according to claim 1 which contains at least about 1.0 weight percent manganese.

10. The alloy according to claim 1 which contains no more than about 1.0 weight percent copper.

11. An austenitic, stainless steel alloy consisting essentially of, in weight percent, about:

| | |
|---|---|
| C | 0.030 max |
| Mn | 2.0 max |
| Si | 1.0 max |
| P | 0.05 max |
| S | 0.020–0.030 |
| Cr | 18.0–19.0 |
| Ni | 10.0–11.0 |
| Mo | 1.0 max |
| Cu | 0.76–1.0 |
| N | 0.030 max |

and the balance being essentially iron.

12. The alloy according to claim 11 which contains no more than about 0.025 weight percent carbon.

13. An austenitic, stainless steel alloy consisting essentially of, in weight percent, about:

| | |
|---|---|
| C | 0.030 max |
| Mn | 2.0 max |
| Si | 1.0 max |
| P | 0.05 max |
| S | 0.020–0.030 |
| Cr | 16.0–17.5 |
| Ni | 10.5–12.5 |
| Mo | 2.0–3.0 |
| Cu | 0.76–1.0 |
| N | 0.030 max |

and the balance being essentially iron.

14. The alloy according to claim 13 which contains no more than about 0.025 weight percent carbon.

15. An austenitic, stainless steel alloy consisting essentially of, in weight percent, about:

| | |
|---|---|
| C | 0.030 max |
| Mn | 2.0 max |
| Si | 1.0 max |
| P | 0.05 max |
| S | 0.020–0.030 |

-continued

| | |
|---|---|
| Cr | 17.0–18.0 |
| Ni | 10.0–11.0 |
| Mo | 1.0 max |
| Cu | 0.76–1.0 |
| N | 0.030 max |
| Ti | (5 × % C) to 0.5 |

and the balance being essentially iron.

16. The alloy according to claim 15 which contains no more than about 0.025 weight percent carbon.

17. An austenitic, stainless steel alloy consisting essentially of, in weight percent, about:

| | |
|---|---|
| C | 0.030 max |
| Mn | 2.0 max |
| Si | 1.0 max |
| P | 0.05 max |
| S | 0.020–0.030 |
| Cr | 17.0–18.0 |
| Ni | 10.0–11.0 |
| Mo | 1.0 max |
| Cu | 0.76–1.0 |
| N | 0.030 max |
| Cb | (10 × % C) to 0.5 |

and the balance being essentially iron.

18. The alloy according to claim 17 which contains no more than about 0.025 weight percent carbon.

19. The alloy according to claim 1 which contains at least about 0.8 weight percent copper.

20. The alloy according to claim 11 which contains at least about 0.8 weight percent copper.

21. The alloy according to claim 13 which contains at least about 0.8 weight percent copper.

22. The alloy according to claim 15 which contains at least about 0.8 weight percent copper.

23. The alloy according to claim 17 which contains at least about 0.8 weight percent copper.

* * * * *